US012631135B2

(12) United States Patent
Kanniaraj et al.

(10) Patent No.: US 12,631,135 B2
(45) Date of Patent: May 19, 2026

(54) NITROGEN OXIDES REDUCTION AGENT INJECTION ARRANGEMENT

(71) Applicant: Volvo Truck Corporation, Gothenburg (SE)

(72) Inventors: Nageswaran Kanniaraj, Gothenburg (SE); Praveen Chougala, Belgaum Karnataka (IN)

(73) Assignee: Volvo Truck Corporation, Gothenburg (SE)

( * ) Notice: Subject to any disclaimer, the term of this patent is extended or adjusted under 35 U.S.C. 154(b) by 0 days.

(21) Appl. No.: 18/661,844

(22) Filed: May 13, 2024

(65) Prior Publication Data

US 2024/0384674 A1 Nov. 21, 2024

(30) Foreign Application Priority Data

May 19, 2023 (EP) ..... 23174224

(51) Int. Cl.
*F01N 3/20* (2006.01)

(52) U.S. Cl.
CPC ..... *F01N 3/206* (2013.01); *F01N 3/208* (2013.01)

(58) Field of Classification Search
CPC ..... F01N 3/206; F01N 3/208; F01N 13/16; F01N 2240/16; F01N 2560/06; F01N 2590/08; F01N 2610/1453; F01N 2610/146; F01N 2900/1811; F01N 2900/1821; F01N 9/00; F01N 3/2066; Y02A 50/20; Y02T 10/12
See application file for complete search history.

(56) References Cited

U.S. PATENT DOCUMENTS

2005/0060086 A1* 3/2005 Abe ..... F02M 51/0664 701/103
2006/0024881 A1 2/2006 Marsh
2010/0186382 A1* 7/2010 Schroeder ..... F01N 3/025 60/324

(Continued)

FOREIGN PATENT DOCUMENTS

EP 3587791 A1 1/2020
JP 60247046 A * 12/1985 ..... F02M 27/08

(Continued)

OTHER PUBLICATIONS

Machine Translation of JP6024746A (Year: 1985).*

(Continued)

*Primary Examiner* — Brandon D Lee
(74) *Attorney, Agent, or Firm* — Withrow & Terranova, PLLC

(57) ABSTRACT

A nitrogen oxides reduction agent injection arrangement for injecting a nitrogen oxides reduction agent, such as urea, into an exhaust conduit forming part of an exhaust system for an internal combustion engine system. The nitrogen oxides reduction agent injection arrangement comprises a nozzle that is adapted to inject the nitrogen oxides reduction agent into the interior of the exhaust conduit via a nozzle opening of the nozzle. The nozzle comprises a nozzle opening control portion made of a shape memory material whereby a size and/or a shape of the nozzle opening is dependent on at least a temperature of the nozzle opening control portion.

12 Claims, 9 Drawing Sheets

(56) References Cited

U.S. PATENT DOCUMENTS

| | | | | |
|---|---|---|---|---|
| 2010/0257844 | A1* | 10/2010 | Shimomura | F01N 3/208 60/299 |
| 2013/0055991 | A1* | 3/2013 | Browne | F02M 26/26 123/568.12 |
| 2015/0196878 | A1* | 7/2015 | Nunez | B01D 53/9418 422/111 |
| 2017/0292426 | A1* | 10/2017 | Cho | F01N 3/208 |
| 2020/0072106 | A1* | 3/2020 | Johnson | F01N 3/0814 |
| 2021/0308701 | A1* | 10/2021 | Frühauf | B01D 53/346 |

FOREIGN PATENT DOCUMENTS

| | | | | |
|---|---|---|---|---|
| JP | S60247046 | A | 12/1985 | |
| JP | H1047049 | A | 2/1998 | |
| WO | WO-2016027023 | A1 * | 2/2016 | A47J 31/467 |

OTHER PUBLICATIONS

Machine Translation of WO 2016027023A1 (Year: 2016).*
Extended European Search Report for European Patent Application No. 24176482.8, mailed Oct. 11, 2024, 8 pages.
Extended European Search Report for European Patent Application No. 23174224.8, mailed Oct. 16, 2023, 8 pages.

* cited by examiner

NITROGEN OXIDES REDUCTION AGENT INJECTION ARRANGEMENT

PRIORITY APPLICATIONS

The present application claims priority to European Patent Application No. 23174224.8, filed on May 19, 2023, and entitled "NITROGEN OXIDES REDUCTION AGENT INJECTION ARRANGEMENT," which is incorporated herein by reference in its entirety.

TECHNICAL FIELD

The disclosure relates generally to a system for injecting a nitrogen oxides reduction agent, such as urea, into an exhaust conduit forming part of an exhaust system for an internal combustion engine system. In particular aspects, the disclosure relates to a nitrogen oxides reduction agent injection arrangement. The disclosure can be applied to heavy-duty vehicles, such as trucks, buses, and construction equipment, among other vehicle types. Although the disclosure may be described with respect to a truck, the disclosure is not restricted to any particular vehicle.

BACKGROUND

An internal combustion engine, in particular a diesel engine, may produce nitrogen oxides such as NO and/or $NO_2$. It is generally desired to reduce the amount of nitrogen oxides emitted to the environment ambient of the internal combustion engine. To this end, an internal combustion engine system may comprise a selective catalytic reduction unit adapted to receive exhaust gases from the internal combustion engine. The exhaust gases reaching the selective catalytic reduction unit may also contain a nitrogen oxides reduction agent, such as urea. The exhaust gas emitted from the selective catalytic reduction unit may have a nitrogen oxides content being lower than the nitrogen oxides content of the exhaust gas entering the selective catalytic reduction unit. It may be desired to control the characteristics of the nitrogen oxides reduction agent that is fed to the selective catalytic reduction unit, e.g., in order to ensure that the nitrogen oxides reduction agent is appropriately mixed with the exhaust gas.

SUMMARY

According to a first aspect of the disclosure, there is provided a nitrogen oxides reduction agent injection arrangement for injecting a nitrogen oxides reduction agent, such as urea, into an exhaust conduit forming part of an exhaust system for an internal combustion engine system. The nitrogen oxides reduction agent injection arrangement comprises a nozzle that is adapted to inject the nitrogen oxides reduction agent into the interior of the exhaust conduit via a nozzle opening of the nozzle. The nozzle comprises a nozzle opening control portion made of a shape memory material whereby a size and/or a shape of the nozzle opening is dependent on at least a temperature of the nozzle opening control portion. The first aspect of the disclosure may seek to facilitate that the nitrogen oxides reduction agent is injected into the exhaust conduit in an appropriate manner. A technical benefit may include that the size and/or the shape of the nozzle opening is controllable which in turn implies that characteristics of the nitrogen oxides reduction agent, such as the flow and/or pressure, may be controlled in a straightforward manner. This in turn may imply that an appropriate mix of the exhaust gas and the nitrogen oxides reduction agent may be arrived at. As a non-limiting example, the shape memory material may be configured such that a size and/or a shape of said nozzle opening is dependent on at least a temperature of the nozzle opening control portion.

Optionally in some examples, including in at least one preferred example, the nozzle opening control portion forms an integral part of the nozzle. A technical benefit may include that the size and/or the shape of the nozzle opening may be controlled with an appropriately low number of separate components.

Optionally in some examples, including in at least one preferred example, the nozzle is made of the shape memory material. A technical benefit may include that the size and/or the shape of the nozzle opening may be controlled with an appropriately low number of separate components.

Optionally in some examples, including in at least one preferred example, the nitrogen oxides reduction agent injection arrangement further comprises a heating element at least thermally connected to the nozzle opening control portion. A technical benefit may include that the temperature of the nozzle opening control portion, and consequently the size and/or the shape of the nozzle opening, may be controlled in a straightforward manner.

Optionally in some examples, including in at least one preferred example, the heating element comprises an electric heating filament connected to the nozzle opening control portion. A technical benefit may include that the electric heating filament is a cost efficient component for controlling the temperature of the nozzle opening control portion.

Optionally in some examples, including in at least one preferred example, the nitrogen oxides reduction agent injection arrangement further comprises a sensor for sensing exhaust gas information, indicative of at least one of the following: a temperature, a mixing pressure and a flow speed, of an exhaust gas in the exhaust conduit upstream of the nozzle. The nitrogen oxides reduction agent injection arrangement further comprises a control unit adapted to receive the exhaust gas information and to control a heating of the heating element in response to the exhaust gas information. A technical benefit may include that the heating of the heating element, and consequently the size and/or the shape of the nozzle opening, may be controlled in response to the exhaust gas information.

Optionally in some examples, including in at least one preferred example, the nitrogen oxides reduction agent injection arrangement further comprises a source of the nitrogen oxides reduction agent and a dosing unit for controlling a flow of the nitrogen oxides reduction agent from the source of the nitrogen oxides reduction agent to the nozzle opening. A technical benefit may include that the supply and dosing of the nitrogen oxides reduction agent is enabled. Purely by way of example, the nitrogen oxides reduction agent may be fed from the source of the nitrogen oxides reduction agent to each one of the nozzles by means of a single dosing unit, that for instance may comprise an actuator, and a nitrogen oxides reduction agent supply rail that is common to all the nozzles. As another non-limiting example, each nozzle may be associated with an individual dosing unit, that for instance may comprise an actuator, and an individual supply rail such that the nitrogen oxides reduction agent may be fed to from the source of nitrogen oxides reduction agent to a nozzle by means of a nozzle dedicated dosing unit and a nozzle dedicated supply rail.

Optionally in some examples, including in at least one preferred example, the shape memory material comprises an alloy comprising any one of the following metals: Nickel and Titanium; Nickel, Titanium and Iron; Nickel, Titanium and Niobium; Nickel, Titanium and Copper; Iron, Manganese and Silicon; Copper, Zinc and Aluminum, and Copper, Aluminum and Nickel. A technical benefit may include that an appropriate shape memory material is obtained.

Optionally in some examples, including in at least one preferred example, the nitrogen oxides reduction agent injection arrangement comprises a plurality of nozzles in accordance with any one of the examples disclosed herein. A technical benefit may include that the arrangement may be able to provide a sufficiently high level of supply of nitrogen oxides reduction agent.

Optionally in some examples, including in at least one preferred example, the nozzles of the plurality of nozzles are adapted to be evenly distributed around a circumference of the exhaust conduit. A technical benefit may include an appropriate mix of the nitrogen oxides reduction agent and the exhaust gas in the exhaust conduit.

Optionally in some examples, including in at least one preferred example, the exhaust conduit has a cross section with a cross sectional center and wherein each nozzle of the plurality of nozzles is adapted to inject the nitrogen oxides reduction agent towards the cross sectional center. A technical benefit may include an appropriate mix of the nitrogen oxides reduction agent in the exhaust conduit.

According to a second aspect of the disclosure, there is provided an exhaust system for an internal combustion engine. The exhaust system comprises an exhaust conduit and a nitrogen oxides reduction agent injection arrangement of the first aspect of the present disclosure. The second aspect of the disclosure may seek to obtain an appropriate mix of exhaust gas and nitrogen oxides reduction agent. A technical benefit may include that the size and/or the shape of the nozzle opening is controllable which in turn implies that characteristics of the nitrogen oxides reduction agent, such as the flow and/or pressure, may be controlled in a straightforward manner.

Optionally in some examples, including in at least one preferred example, the exhaust system further comprises a selective catalytic reduction unit being adapted to receive exhaust gases from the exhaust conduit, the selective catalytic reduction unit being located downstream of the nitrogen oxides reduction agent injection arrangement as seen in a direction of flow of the exhaust gas. A technical benefit may include that the selective catalytic reduction unit and the nitrogen oxides reduction agent injection arrangement together may reduce the amount of nitrogen oxides leaving the selective catalytic reduction unit.

According to a third aspect of the disclosure, there is provided an internal combustion engine system comprising an internal combustion engine and a nitrogen oxides reduction agent injection arrangement of the first aspect of the present disclosure or an exhaust system of the second aspect of the present disclosure. The third aspect of the disclosure may seek to enable that the amount of nitrogen oxides emitted from an internal combustion engine system is appropriately low. A technical benefit may include that the injection of the nitrogen oxides reduction agent is controlled in an appropriate manner which in turn implies that the amount of emitted nitrogen oxides may be appropriately low.

According to a fourth aspect of the disclosure, there is provided a vehicle comprising a nitrogen oxides reduction agent injection arrangement of the first aspect of the present disclosure or an exhaust system of the second aspect of the present disclosure or an internal combustion engine system of the third aspect of the present disclosure. The fourth aspect of the disclosure may seek to enable that the amount of nitrogen oxides emitted from a vehicle is appropriately low. A technical benefit may include that the injection of the nitrogen oxides reduction agent is controlled in an appropriate manner which in turn implies that the amount of emitted nitrogen oxides may be appropriately low.

According to a fifth aspect of the disclosure, there is provided a method for controlling injection of a nitrogen oxides reduction agent, such as urea, into an exhaust conduit forming part of an exhaust system for an internal combustion engine system, using a nitrogen oxides reduction agent injection arrangement. The nitrogen oxides reduction agent injection arrangement comprises a nozzle that is adapted to inject the nitrogen oxides reduction agent into the interior of the exhaust conduit via a nozzle opening of the nozzle. The nozzle comprises a nozzle opening control portion made of a shape memory material whereby a size and/or a shape of the nozzle opening is dependent on at least a temperature of the nozzle opening control portion. The nitrogen oxides reduction agent injection arrangement comprises a heating element at least thermally connected to the nozzle opening control portion. The method comprises sensing exhaust gas information, indicative of at least one of the following: a temperature, a mixing pressure and a flow speed, of an exhaust gas in the exhaust conduit upstream of the nozzle and controlling a heating of the heating element in response to the exhaust gas information. A technical benefit may include that the injection of the nitrogen oxides reduction agent is controlled in an appropriate manner which in turn implies that the amount of emitted nitrogen oxides may be appropriately low.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

Figure 1:
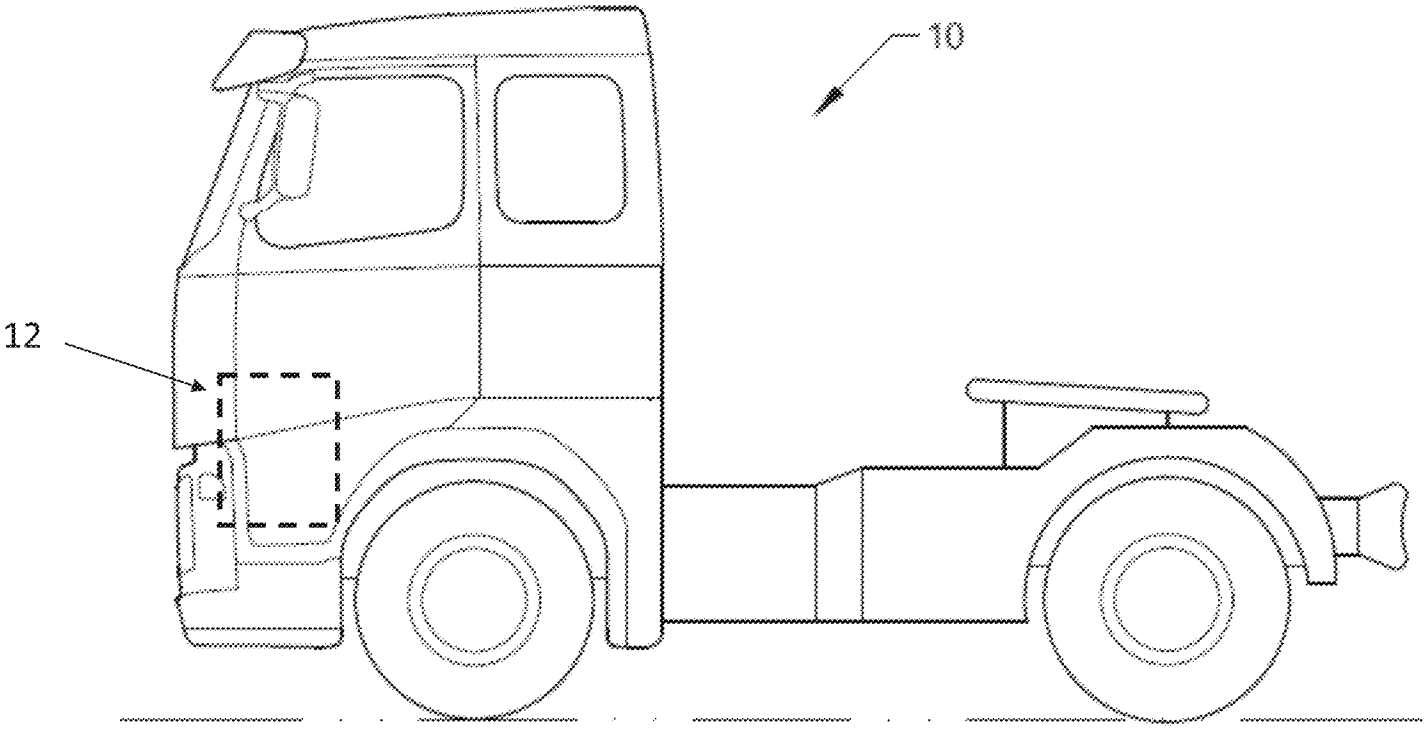
FIG. 1 is a side view of a vehicle, in the form of a truck, according to an example.

FIG. 1 is a side view of a vehicle 10, in the form of a truck, according to an example. The vehicle 10 may comprise an internal combustion engine system 12 which is schematically indicated in FIG. 1.

Figure 2:
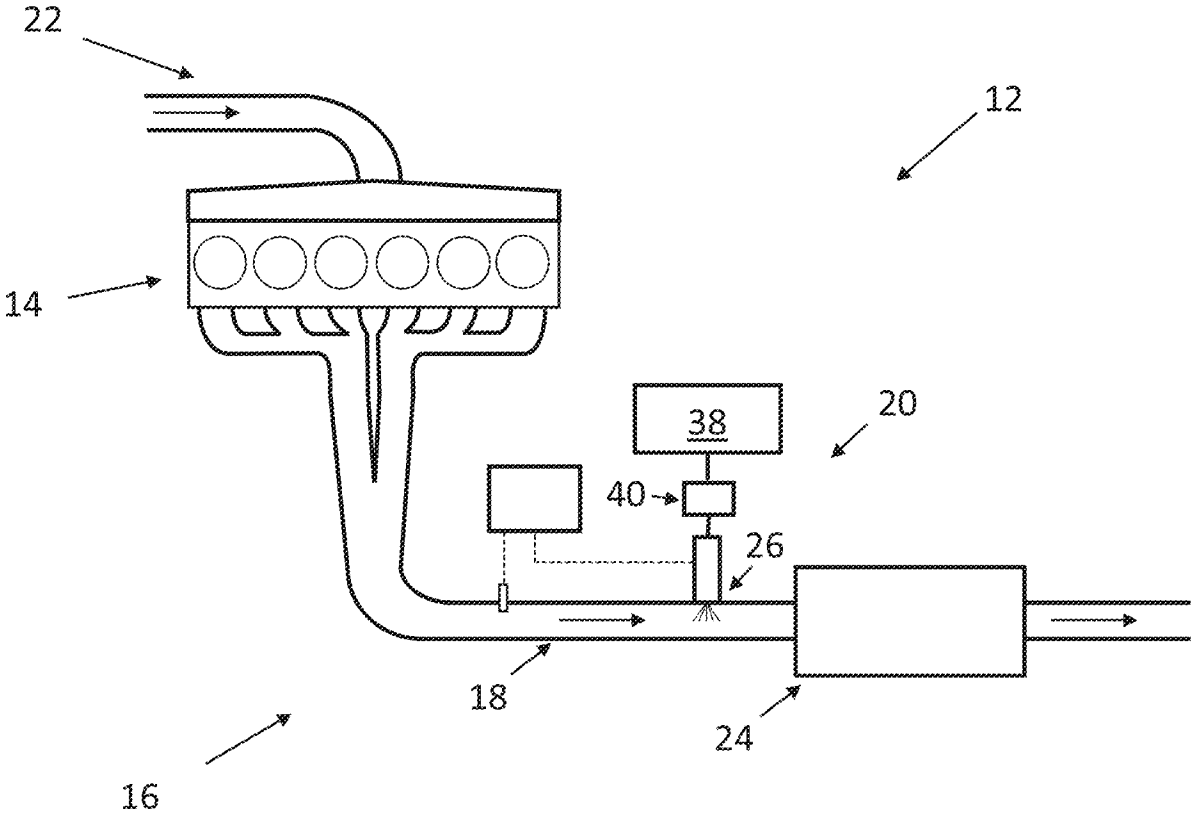
FIG. 2 is a schematic illustration of an internal combustion engine system, according to an example.

FIG. 2 is a schematic illustration of an internal combustion engine system 12, according to an example. As indicated in FIG. 2, the internal combustion engine system 12 comprises an internal combustion engine 14 and an exhaust system 16. As a non-limiting example, the internal combustion engine 14 may be a diesel engine. Irrespective of the type of engine, the internal combustion engine 14 may be adapted to feed exhaust gas to the exhaust system 16. Moreover, the exhaust system 16 may comprise an exhaust conduit 18 and a nitrogen oxides reduction agent injection arrangement 20. Additionally, as a non-limiting example, the internal combustion engine system 12 may comprise an inlet system 22 adapted to feed inlet gas, such as air, to the internal combustion engine 14.

Furthermore, as a non-limiting example, the exhaust system 16 may comprise a selective catalytic reduction unit 24 which is adapted to receive exhaust gases from the exhaust conduit 18. As indicated in FIG. 2, the selective catalytic reduction unit 24 may be located downstream of the nitrogen oxides reduction agent injection arrangement 20 as seen in a direction of flow of the exhaust gas, which direction of flow is indicated by arrows in FIG. 2. Purely by way of example, the selective catalytic reduction unit 24 may comprise a metal or an alloy layer (not shown) comprising one or more of the following: platinum and palladium.

Figure 3:
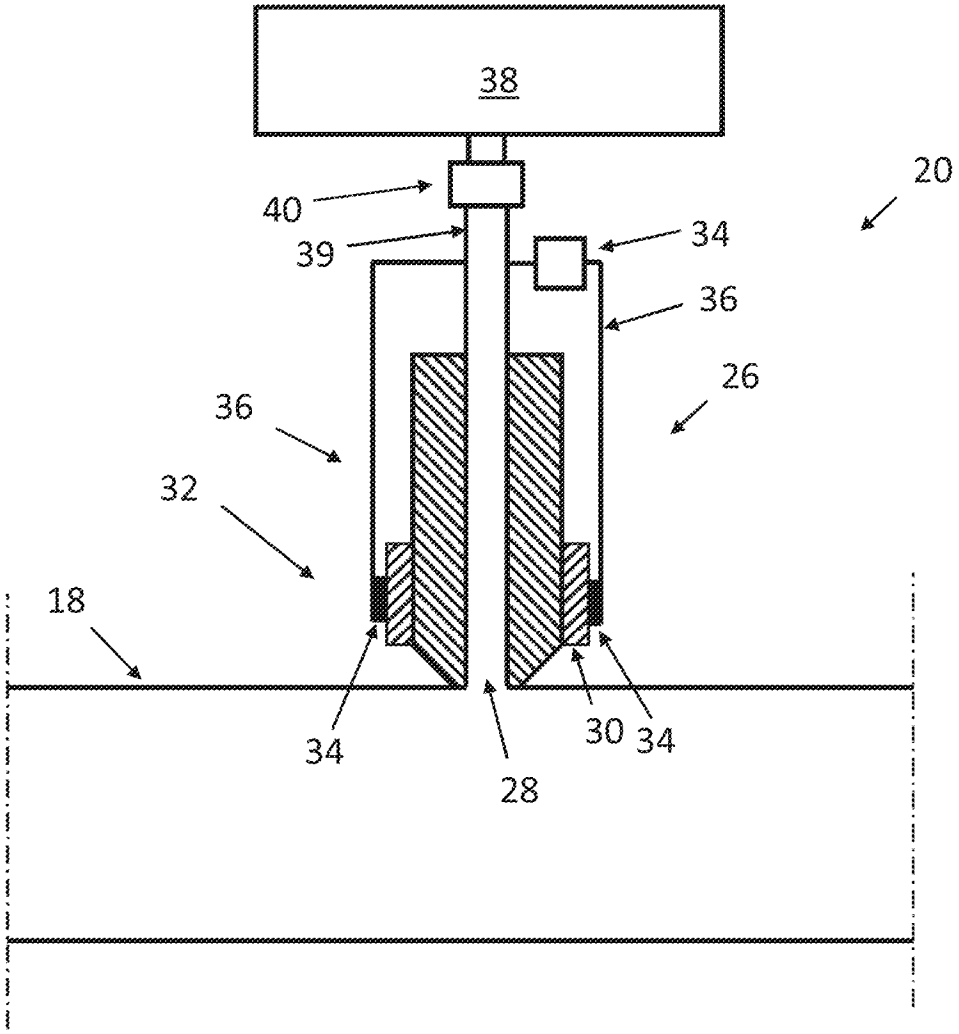
FIG. 3 is a schematic illustration of a nitrogen oxides reduction agent injection arrangement, according to an example.

FIG. 3 is a schematic illustration of a nitrogen oxides reduction agent injection arrangement 20, according to an example. The nitrogen oxides reduction agent injection arrangement 20 is adapted to inject a nitrogen oxides reduction agent, such as urea, into an exhaust conduit 10 forming part of an exhaust system 16 (see FIG. 2) for an internal combustion engine system 12 (see FIG. 2). The nitrogen oxides reduction agent injection arrangement 20 comprises a nozzle 26 that is adapted to inject the nitrogen oxides reduction agent into the interior of the exhaust conduit 18 via a nozzle opening 28 of the nozzle 26. The nozzle 26 comprises a nozzle opening control portion 30 made of a shape memory material whereby a size and/or a shape of the nozzle opening 28 is dependent on at least a temperature of the nozzle opening control portion 30. In the FIG. 3 example, the nozzle opening control portion 30 is a component separate from the portion of the nozzle 26 accommodating the nozzle opening 28. However, other examples of the nozzle opening control portion 30 will be presented hereinbelow.

However, for every example of the nozzle opening control portion 30, the shape memory material may comprise an alloy comprising any one of the following metals: Nickel and Titanium; Nickel, Titanium and Iron; Nickel, Titanium and Niobium; Nickel, Titanium and Copper; Iron, Manganese and Silicon; Copper, Zinc and Aluminum, and Copper, Aluminum and Nickel.

Irrespective of the implementation of the nozzle opening control portion 30, as indicated the FIG. 3 example, the nitrogen oxides reduction agent injection 20 may comprise a heating element 32 at least thermally connected to the nozzle opening control portion 30. Purely by way of example, the heating element 32 may comprise an electric heating filament 34 connected to the nozzle opening control portion 30. Moreover, though purely by way of example, the nitrogen oxides reduction agent injection arrangement 20 may comprise a source of energy 34, such as electric or thermal energy, which in turn is connected to the heating element 32, e.g. the electric heating filament 34, by means of one or more energy conducting elements 36. As a non-limiting example, the source of energy 34 may be a source of electric energy, such as a battery, and each one of the one or more energy conducting elements 36 may be referred to as an electrical harness. As such, by controlling the heating element 32, e.g., by controlling the source of energy 34 in the FIG. 3 example, the temperature of the nozzle opening control portion 30 may be controlled which in turn controls the size and/or the shape of the nozzle opening 28.

Furthermore, as a non-limiting example, as indicated in each one of the FIG. 2 and FIG. 3 examples, the nitrogen oxides reduction agent injection arrangement 20 may comprise a source 38 of the nitrogen oxides reduction agent and a dosing unit 40 for controlling a flow of the nitrogen oxides reduction agent from the source 38 of the nitrogen oxides reduction agent to the nozzle opening 28. Purely by way of example, the dosing unit 40 may comprise an actuator (not shown). Purely by way of example, as indicated in FIG. 3, each nozzle 26 may be associated with an individual dosing unit 40 and an individual supply rail 39 such that the nitrogen oxides reduction agent may be fed to from the source 38 of nitrogen oxides reduction agent to a nozzle by means of a nozzle dedicated dosing unit 40 and a nozzle dedicated supply rail 39.

Figure 4B:
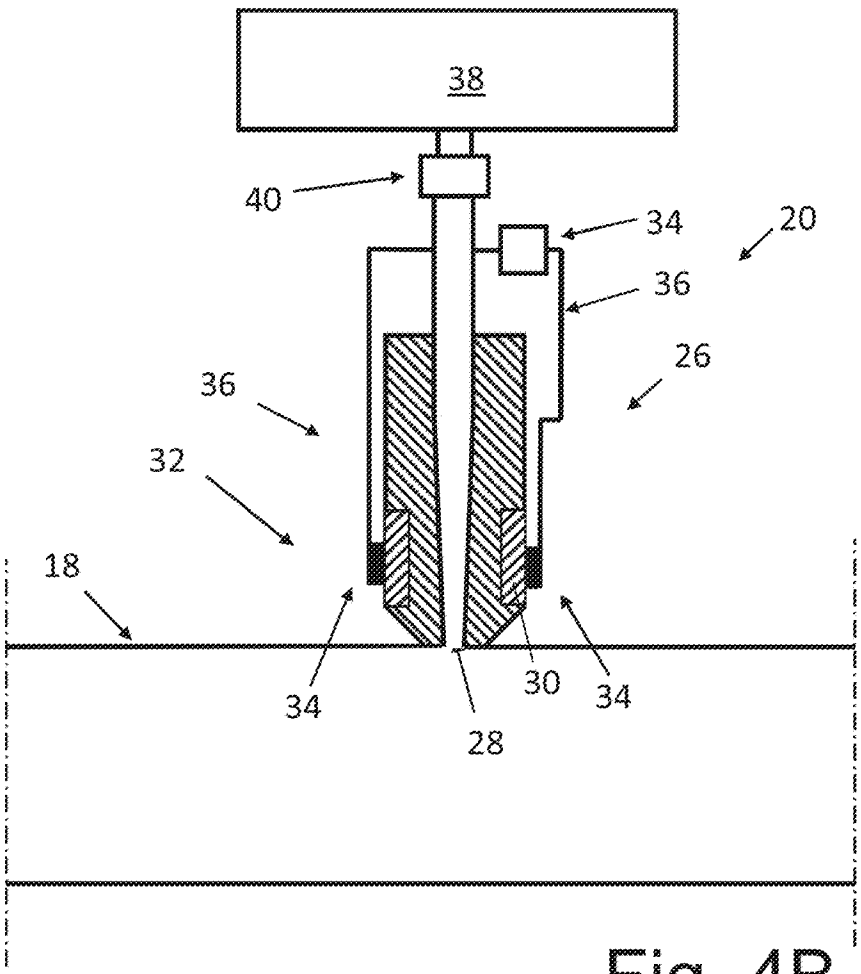
FIG. 4A-FIG. 4C are schematic illustrations of a nitrogen oxides reduction agent injection arrangement, according to an example.
Figure 4A:
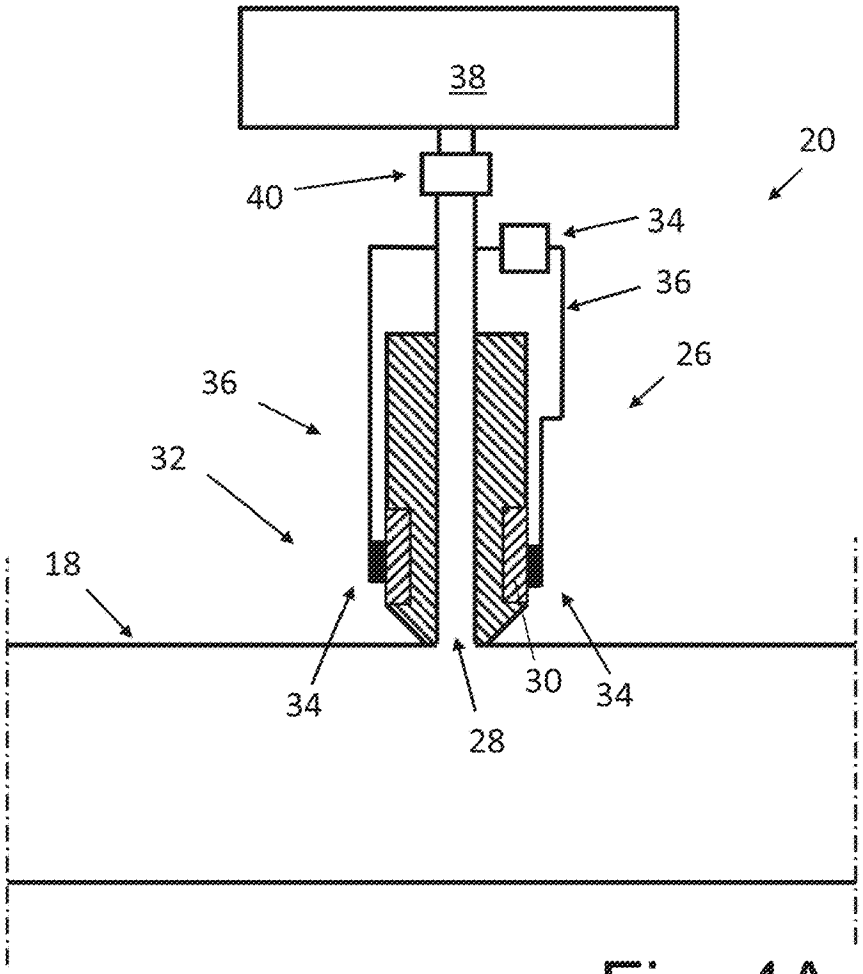
Figure 4C:
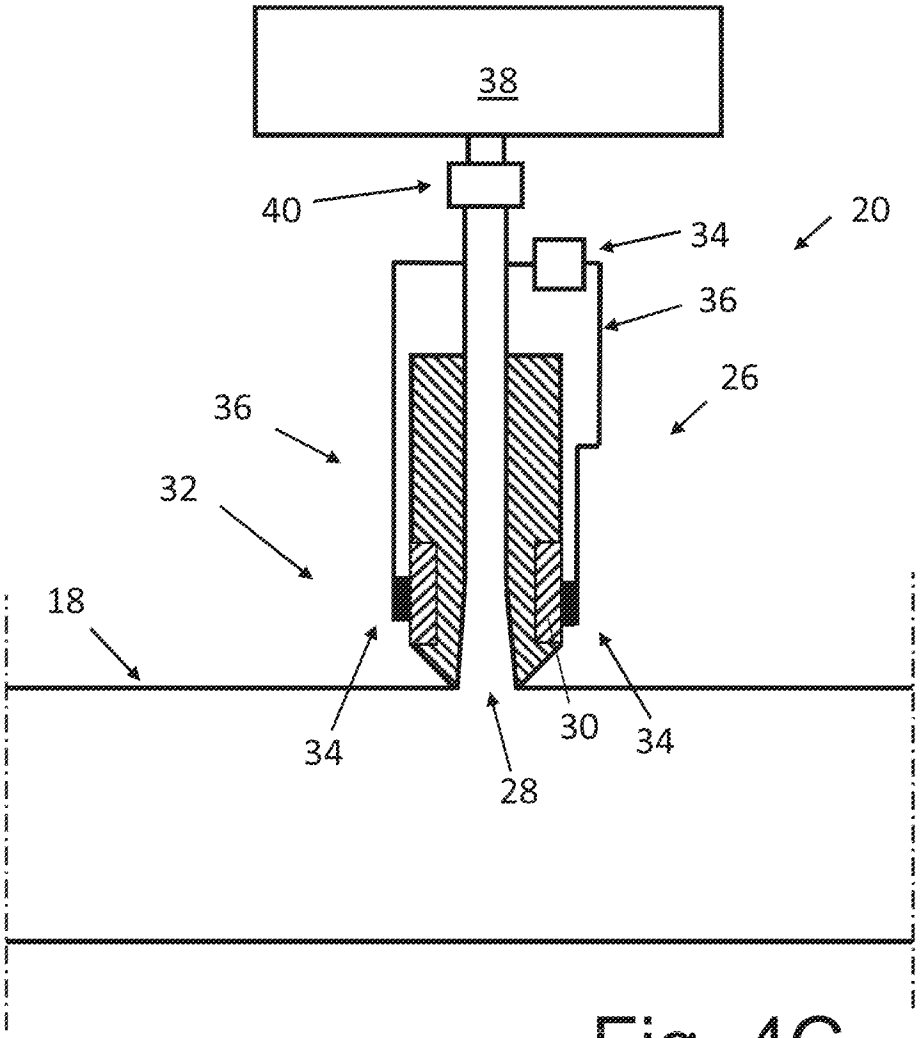

FIG. 4A is a schematic illustration of a nitrogen oxides reduction agent injection arrangement 20, according to an example. As compared to the FIG. 3 example, in the FIG. 4A example, the nozzle opening control portion 30 forms an integral part of the nozzle 26. Moreover, as indicated in FIG. 4B and FIG. 4C, the nozzle opening control portion 30 may be controlled so as to constrict at least a portion of the nozzle opening 28 (see FIG. 4B) and/or to expand at least a portion of the nozzle opening 28 (see FIG. 4C).

Figure 5:
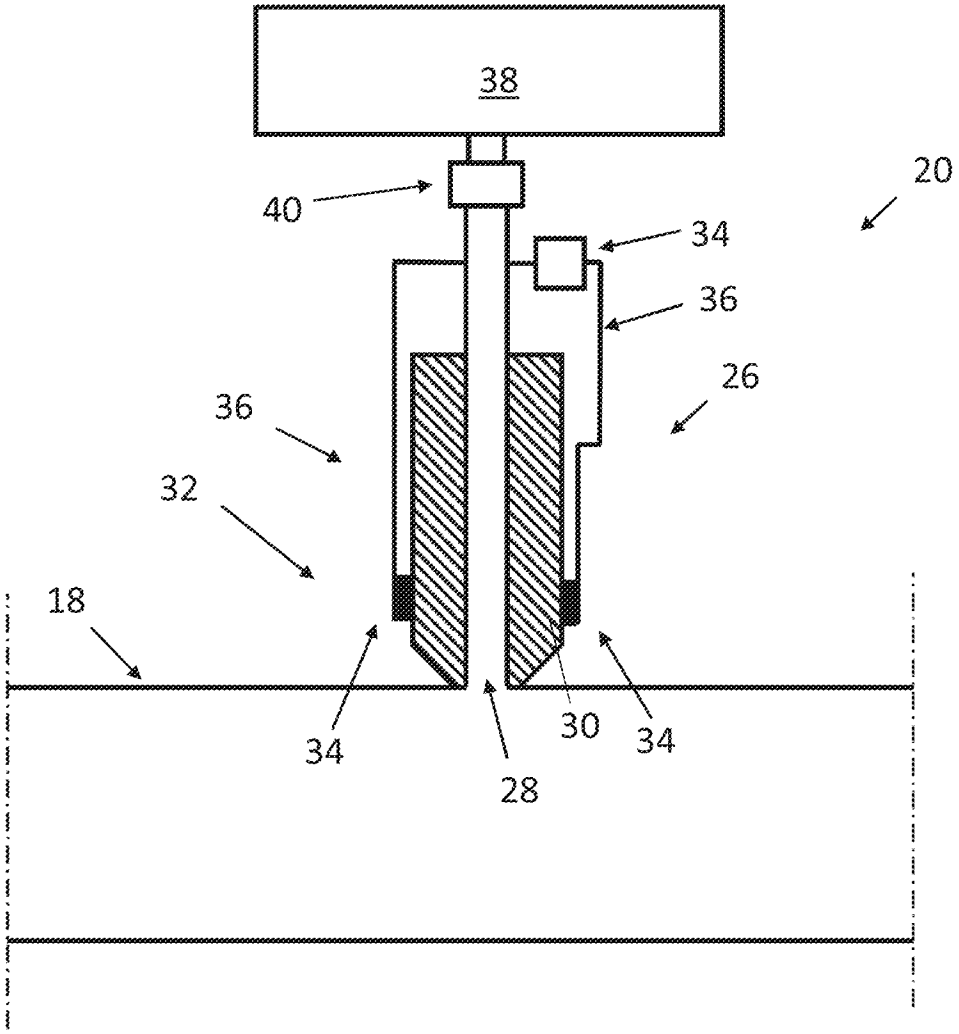
FIG. 5 is a schematic illustration of a nitrogen oxides reduction agent injection arrangement, according to an example.

FIG. 5 is a schematic illustration of a nitrogen oxides reduction agent injection arrangement 20, according to an example. As compared to the FIG. 3 and FIG. 4A-4C examples, in the FIG. 5 example, the nozzle 26 is made of the shape memory material. As such, in the FIG. 5 example, the nozzle opening control portion 30 is the nozzle 26.

Figure 6:
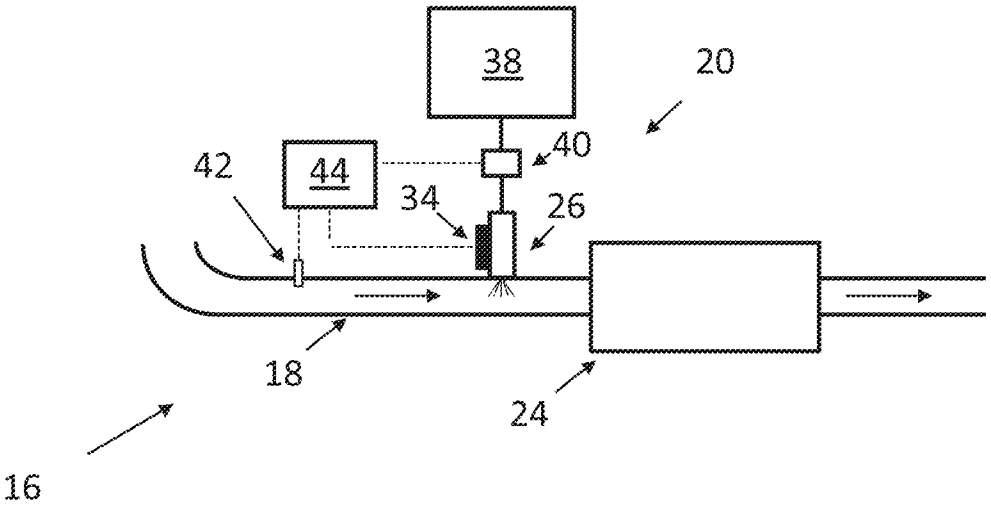
FIG. 6 is a schematic illustration of a nitrogen oxides reduction agent injection arrangement, according to an example.

FIG. 6 is a schematic illustration of a nitrogen oxides reduction agent injection arrangement 20, according to an example. In the FIG. 6 example, the nitrogen oxides reduction agent injection arrangement 20 further comprises a sensor 42 for sensing exhaust gas information, indicative of at least one of the following: a temperature, a mixing pressure and a flow speed, of an exhaust gas in the exhaust conduit 18 upstream of the nozzle. Moreover, as indicated in FIG. 6, the nitrogen oxides reduction agent injection arrangement 20 may further comprise a control unit 44 adapted to receive the exhaust gas information and to control a heating of the heating element 34 in response to the exhaust gas information.

Moreover, though purely by way of example, the control unit 44 may also be adapted to issue control information to the dosing unit 40 of the nitrogen oxides reduction agent injection arrangement 20.

Figure 7:
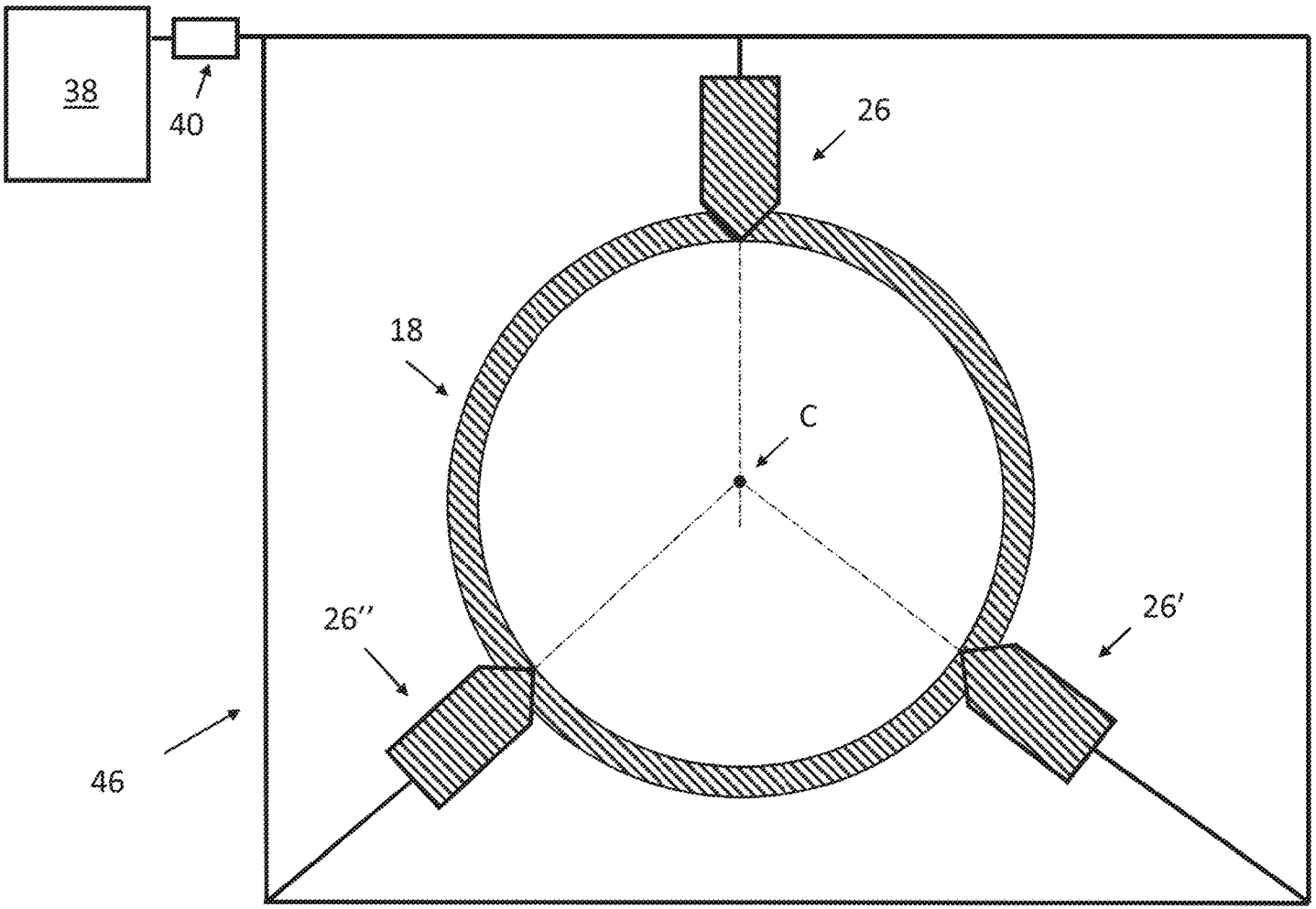
FIG. 7 is a schematic illustration of a nitrogen oxides reduction agent injection arrangement, according to an example.

FIG. 7 is a schematic illustration of a nitrogen oxides reduction agent injection arrangement 20, according to an example. As indicated in FIG. 7, the nitrogen oxides reduction agent injection arrangement 20 may comprise a plurality of nozzles 26, 26', 26", for instance a plurality of nozzles 26, 26', 26" in accordance with any one of the examples presented hereinabove. Moreover, as illustrated in FIG. 7 by way of example only, the nozzles of the plurality of nozzles 26, 26', 26" may be adapted to be evenly distributed around a circumference of the exhaust conduit. Moreover, as a non-limiting example, the exhaust conduit 18 may have a cross section with a cross sectional center C and each nozzle of the plurality of nozzles 26, 26', 26" may be adapted to inject the nitrogen oxides reduction agent towards the cross sectional center. Purely by way of example, as exemplified in FIG. 7, the nitrogen oxides reduction agent may be fed from a source 38 of the nitrogen oxides reduction agent to each one of the nozzles 26, 26', 26" by means of a single dosing unit 40, that for instance may comprise an actuator, and a nitrogen oxides reduction agent supply rail 46 that is common to all the nozzles. As another non-limiting example, each nozzle 26, 26', 26" may be associated with an individual dosing unit (not shown), that for instance may comprise an actuator, and an individual supply rail (not shown) such that the nitrogen oxides reduction agent may be fed to from the source of nitrogen oxides reduction agent to a nozzle by means of a nozzle dedicated dosing unit and a nozzle dedicated supply rail.

Figure 8:
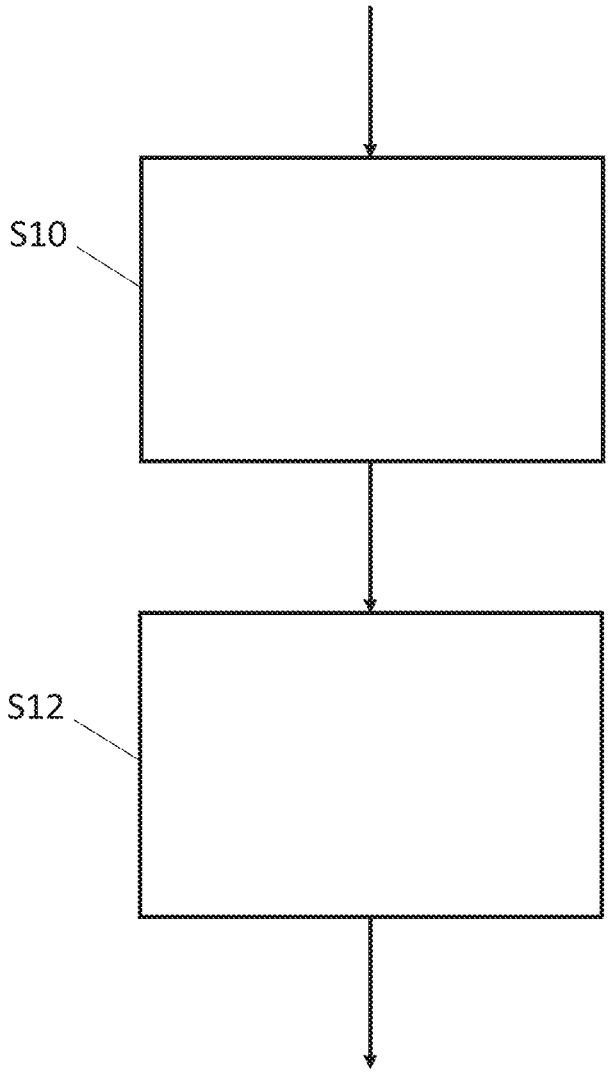
FIG. 8 is a flowchart of a method, according to an example.

FIG. 8 is a flow chart of a method for controlling injection of a nitrogen oxides reduction agent, such as urea, into an exhaust conduit 18 forming part of an exhaust system 16 for an internal combustion engine system 12, using a nitrogen oxides reduction agent injection arrangement 20. As has been indicated above, the nitrogen oxides reduction agent injection arrangement 20 comprises a nozzle 26 that is adapted to inject the nitrogen oxides reduction agent into the interior of the exhaust conduit 18 via a nozzle opening 28 of the nozzle 26. The nozzle 26 comprises a nozzle opening control portion 30 made of a shape memory material whereby a size and/or a shape of the nozzle opening 28 is dependent on at least a temperature of the nozzle opening control portion 30. The nitrogen oxides reduction agent injection arrangement 20 comprises a heating element 34 at least thermally connected to the nozzle opening control portion 30. The method comprises: S10 sensing exhaust gas information, indicative of at least one of the following: a temperature, a mixing pressure and a flow speed, of an exhaust gas in the exhaust conduit 18 upstream of the nozzle 26, and S12 controlling a heating of the heating element 34 in response to the exhaust gas information.

It should be noted that the present disclosure may be presented in accordance with any one of the below Examples.

Example 1: A nitrogen oxides reduction agent injection arrangement 20 for injecting a nitrogen oxides reduction agent, such as urea, into an exhaust conduit 18 forming part of an exhaust system 16 for an internal combustion engine system 12, the nitrogen oxides reduction agent injection arrangement 20 comprising a nozzle 26 that is adapted to inject the nitrogen oxides reduction agent into the interior of the exhaust conduit 18 via a nozzle opening 28 of the nozzle 26, the nozzle 26 comprising a nozzle opening control portion 30 made of a shape memory material whereby a size and/or a shape of the nozzle opening 28 is dependent on at least a temperature of the nozzle opening control portion 30.

Example 2: The nitrogen oxides reduction agent injection arrangement 20 of Example 1, wherein the nozzle opening control portion 30 forms an integral part of the nozzle 26.

Example 3: The nitrogen oxides reduction agent injection arrangement 20 of Example 2, wherein the nozzle 26 is made of the shape memory material.

Example 4: The nitrogen oxides reduction agent injection arrangement 20 of any one of the preceding Examples, further comprising a heating element 34 at least thermally connected to the nozzle opening control portion 30.

Example 5: The nitrogen oxides reduction agent injection arrangement 20 of Example 4, wherein the heating element 34 comprises an electric heating filament 36 connected to the nozzle opening control portion 30.

Example 6: The nitrogen oxides reduction agent injection arrangement 20 of Example 4 or Example 5, further comprising a sensor 42 for sensing exhaust gas information, indicative of at least one of the following: a temperature, a mixing pressure and a flow speed, of an exhaust gas in the exhaust conduit 18 upstream of the nozzle 26, the nitrogen oxides reduction agent injection arrangement 20 further comprising a control unit 44 adapted to receive the exhaust gas information and to control a heating of the heating element 34 in response to the exhaust gas information.

Example 7: The nitrogen oxides reduction agent injection arrangement 20 of any one of the preceding Examples, further comprising a source 38 of the nitrogen oxides reduction agent and a dosing unit 40 for controlling a flow of the nitrogen oxides reduction agent from the source 38 of the nitrogen oxides reduction agent to the nozzle opening 28.

Example 8: The nitrogen oxides reduction agent injection arrangement 20 of any one of the preceding Examples, wherein the shape memory material comprises an alloy comprising any one of the following metals: Nickel and Titanium; Nickel, Titanium and Iron; Nickel, Titanium and Niobium; Nickel, Titanium and Copper; Iron, Manganese and Silicon; Copper, Zinc and Aluminum, and Copper, Aluminum and Nickel.

Example 9: The nitrogen oxides reduction agent injection arrangement 20 of any one of the preceding Examples, wherein the nitrogen oxides reduction agent injection arrangement 20 comprises a plurality of nozzles 26, 26', 26" in accordance with any one of the preceding Examples.

Example 10: The nitrogen oxides reduction agent injection arrangement 20 of Example 9, wherein the nozzles of the plurality of nozzles 26, 26', 26" are adapted to be evenly distributed around a circumference of the exhaust conduit 18.

Example 11: The nitrogen oxides reduction agent injection arrangement 20 of Example 9 or Example 10, wherein the exhaust conduit 18 has a cross section with a cross sectional center C and wherein each nozzle 26 of the plurality of nozzles 26, 26', 26" is adapted to inject the nitrogen oxides reduction agent towards the cross sectional center C.

Example 12: An exhaust system 16 for an internal combustion engine, the exhaust system 16 comprising an exhaust conduit 18 and a nitrogen oxides reduction agent injection arrangement 20 of any one of the preceding Examples.

Example 13: The exhaust system 16 of Example 12, further comprising a selective catalytic reduction unit 24 being adapted to receive exhaust gases from the exhaust conduit 18, the selective catalytic reduction unit 24 being located downstream of the nitrogen oxides reduction agent injection arrangement 20 as seen in a direction of flow of the exhaust gas.

Example 14: An internal combustion engine system 12 comprising an internal combustion engine 14 and a nitrogen oxides reduction agent injection arrangement 20 of any one of Examples 1-11 or an exhaust system 16 of any one of Examples 12-13.

Example 15: A vehicle 10 comprising a nitrogen oxides reduction agent injection arrangement 20 of any one of Examples 1-11 or an exhaust system 16 of any one of Examples 12-13 or an internal combustion engine system 12 of Example 14.

Example 16: A method for controlling injection of a nitrogen oxides reduction agent, such as urea, into an exhaust conduit 18 forming part of an exhaust system 16 for an internal combustion engine system 12, using a nitrogen oxides reduction agent injection arrangement 20, wherein the nitrogen oxides reduction agent injection arrangement 20 comprises a nozzle 26 that is adapted to inject the nitrogen oxides reduction agent into the interior of the exhaust conduit 18 via a nozzle opening 28 of the nozzle 26, the nozzle 26 comprising a nozzle opening control portion 30 made of a shape memory material whereby a size and/or a shape of the nozzle opening 28 is dependent on at least a temperature of the nozzle opening control portion 30, wherein the nitrogen oxides reduction agent injection arrangement 20 comprises a heating element 34 at least thermally connected to the nozzle opening control portion 30, wherein the method comprises sensing exhaust gas information, indicative of at least one of the following: a temperature, a mixing pressure and a flow speed, of an exhaust gas in the exhaust conduit 18 upstream of the nozzle 26, and controlling a heating of the heating element 34 in response to the exhaust gas information. It should be noted that the method may be carried out with any example of the nitrogen oxides reduction agent injection arrangement 20 as presented above or in the below appended claims.

It should be noted that, as used in the present application, gases NO and/or $NO_2$ may also be referred to as nitric oxide. As such, as used in the present application, a nitrogen oxides reduction agent may also be referred to as a nitric oxide reduction agent. Alternatively, the term NO and/or $NO_2$ reduction agent may be used. As may be realized from the above, as used in the present application, the terms "nitrogen oxides reduction agent", "nitric oxide reduction agent" and "NO and/or $NO_2$ reduction agent" are equivalent and can thus be used interchangeably.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

What is claimed is:

1. A nitrogen oxides reduction agent injection arrangement for injecting a nitrogen oxides reduction agent into an exhaust conduit forming part of an exhaust system for an internal combustion engine system, comprising:

a plurality of nozzles adapted to be evenly distributed around a circumference of the exhaust conduit, wherein the exhaust conduit has a cross section with a cross sectional center and wherein each nozzle of the plurality of nozzles is adapted to inject the nitrogen oxides reduction agent towards the cross sectional center;

a source of the nitrogen oxides reduction agent and a single dosing unit for controlling a flow of the nitrogen oxides reduction agent from the source of the nitrogen oxides reduction agent to a nozzle opening of each one of the plurality of nozzles;

each nozzle being adapted to inject the nitrogen oxides reduction agent into an interior of the exhaust conduit via the nozzle opening of each nozzle, each nozzle comprising a nozzle opening control portion made of a shape memory material whereby a size and/or a shape of the nozzle opening is dependent on at least a temperature of the nozzle opening control portion;

each nozzle comprising a heating element at least thermally connected to the nozzle opening control portion;

a sensor for sensing exhaust gas information indicative of at least one of the following: a temperature, a mixing pressure, and a flow speed, of an exhaust gas in the exhaust conduit upstream of the plurality of nozzle; and a control unit adapted to receive the exhaust gas information and to control a heating of the heating elements in response to the exhaust gas information.

2. The nitrogen oxides reduction agent injection arrangement of claim 1, wherein the nozzle opening control portion forms an integral part of each nozzle.

3. The nitrogen oxides reduction agent injection arrangement of claim 2, wherein the nozzle is made of the shape memory material.

4. The nitrogen oxides reduction agent injection arrangement of claim 1, wherein the heating element comprises an electric heating filament connected to the nozzle opening control portion.

5. The nitrogen oxides reduction agent injection arrangement of claim 1, wherein the shape memory material comprises an alloy comprising any one of the following metals: Nickel and Titanium; Nickel, Titanium and Iron; Nickel, Titanium and Niobium; Nickel, Titanium and Copper; Iron, Manganese and Silicon; Copper, Zinc and Aluminum, and Copper, Aluminum and Nickel.

6. An exhaust system for an internal combustion engine, the exhaust system comprising an exhaust conduit and the nitrogen oxides reduction agent injection arrangement of claim 1.

7. The exhaust system of claim 6, further comprising a selective catalytic reduction unit being adapted to receive exhaust gases from the exhaust conduit, the selective catalytic reduction unit being located downstream of the nitrogen oxides reduction agent injection arrangement as seen in a direction of flow of the exhaust gas.

8. An internal combustion engine system comprising an internal combustion engine and the nitrogen oxides reduction agent injection arrangement of claim 1.

9. A vehicle comprising the nitrogen oxides reduction agent injection arrangement of claim 1.

10. An internal combustion engine system comprising an internal combustion engine and the exhaust system of claim 6.

11. A vehicle comprising the exhaust system of claim 6.

12. A vehicle comprising the internal combustion engine system of claim 8.

* * * * *